US007113103B2

(12) United States Patent
Festa et al.

(10) Patent No.: US 7,113,103 B2
(45) Date of Patent: Sep. 26, 2006

(54) MODULAR SECURITY, MONITORING, AND CONTROL DEVICES AND METHODS

(75) Inventors: James M. Festa, Boca Raton, FL (US); Steven Hemmer, Boca Raton, FL (US); Charles Eurich, Coconut Creek, FL (US); Randall Provoost, Boynton Beach, FL (US); Thomas Edward Marshall, Lake Worth, FL (US)

(73) Assignee: General Electric Company, Schenectady, NY (US)

( * ) Notice: Subject to any disclaimer, the term of this patent is extended or adjusted under 35 U.S.C. 154(b) by 111 days.

(21) Appl. No.: 10/660,181

(22) Filed: Sep. 11, 2003

(65) Prior Publication Data

US 2005/0057360 A1 Mar. 17, 2005

(51) Int. Cl.
*G08B 21/00* (2006.01)

(52) U.S. Cl. ..... 340/652; 340/568.1; 340/686.4; 340/687; 439/509

(58) Field of Classification Search ..... 340/521, 340/545, 568.1, 652, 686.1, 686.2, 686.4, 340/687; 361/683, 730; 439/501, 509
See application file for complete search history.

(56) References Cited

U.S. PATENT DOCUMENTS

| | | | | |
|---|---|---|---|---|
| 5,675,319 | A * | 10/1997 | Rivenberg et al. | 340/550 |
| 5,858,500 | A * | 1/1999 | MacPherson | 428/68 |
| 5,938,472 | A * | 8/1999 | Yuen et al. | 439/509 |
| 6,512,454 | B1 * | 1/2003 | Miglioli et al. | 340/541 |
| 6,646,565 | B1 * | 11/2003 | Fu et al. | 340/687 |
| 6,774,807 | B1 * | 8/2004 | Lehfeldt et al. | 340/686.1 |
| 2002/0067264 | A1 * | 6/2002 | Soehnlen | 340/572.1 |
| 2002/0113705 | A1 * | 8/2002 | Wallace | 340/568.7 |
| 2003/0189491 | A1 * | 10/2003 | Ng | 340/572.9 |
| 2004/0124980 | A1 * | 7/2004 | Sisson et al. | 340/568.1 |

* cited by examiner

*Primary Examiner*—Daniel Wu
*Assistant Examiner*—George Bugg
(74) *Attorney, Agent, or Firm*—Ohlandt, Greeley, Ruggiero & Perle, L.L.P.

(57) ABSTRACT

A modular security, monitoring, and control device having a core module, an input/output module, a first peripheral, a first end cap, and a tamper monitor. The core and input/output modules in electrical communication with one another. The first peripheral is removably connected to the core module so that the core module and the first peripheral are in electrical communication. The first end cap is removably connected to the first peripheral. The tamper monitor detects tampering with the first peripheral.

19 Claims, 2 Drawing Sheets

MODULAR SECURITY, MONITORING, AND CONTROL DEVICES AND METHODS

BACKGROUND OF INVENTION

The present disclosure relates to security, monitoring, and control devices. More particularly, the present disclosure relates to modular security, monitoring, and control devices and methods.

Numerous types of security, monitoring, and control devices are known. For example, many commercial buildings have access control systems to allow only authorized employees into the building, and even to limit employee access to certain parts of the building. The access control can be an electronic system such as a personal identification number (PIN) input device, a magnetic stripe reader, a proximity reader, and others. These same commercial buildings often have security cameras, smoke detectors, HVAC systems, and employee time card stations. Each of these various security, monitoring, and control devices collects information, and often times makes decisions based on this information.

While the information collected by one of these devices may be useful to other devices, many of the prior art devices can not communicate to one another. This leads to less than optimal decisions or the requirement for duplicative collection of the same data by multiple devices. For example, temperature control systems, burglar alarms, and access control devices are often installed in a common location, but do not exchange information with one another.

For this reason, integrated security, monitoring, and control devices are becoming popular. However, these systems typically require large financial investments to design and install the integrated system. Moreover, such systems often do not communicate with existing systems already in place.

In addition, many prior art devices do not function with more than one technology. As discussed above, many different types of access control systems have been developed. Unfortunately, in order to have an access control device that works with both a PIN input device and a magnetic stripe reader, two separate devices would need to be installed at each point of entrance/exit. Alternately, all of the entrance/exit would need to be outfitted with an expensive dual technology system.

Accordingly, there is a continuing desire for easily modified security, monitoring, and control devices that allow integration of the data among various system components.

BRIEF DESCRIPTION OF THE INVENTION

A modular security, monitoring, and control device is provided. The modular device includes a core module, an input/output module, a first peripheral, a first end cap, and a tamper monitor. The core and input/output modules in electrical communication with one another. The first peripheral is removably connected to the core module so that the core module and the first peripheral are in electrical communication. The first end cap is removably connected to the first peripheral. The tamper monitor detects tampering with the first peripheral.

A modular device including a processor and a plurality of peripheral devices is also provided. The processor is in electrical communication with an input/output device. The peripheral devices are secured to the processor so that each of the peripheral devices is in electrical communication with the processor. The processor collects similar and/or dissimilar data from each of the plurality of peripheral devices.

A method of forming a security, monitoring, and control device is also provided. The method includes placing a core module in electrical communication with an input/output module, the core module being configured to place the input/output module in electrical communication with a plurality of peripherals having similar and/or dissimilar data; and plugging a first peripheral into the core module so that the first peripheral is physically connected to and is in electrical communication with the core module.

DETAILED DESCRIPTION OF THE INVENTION

Figure 1:
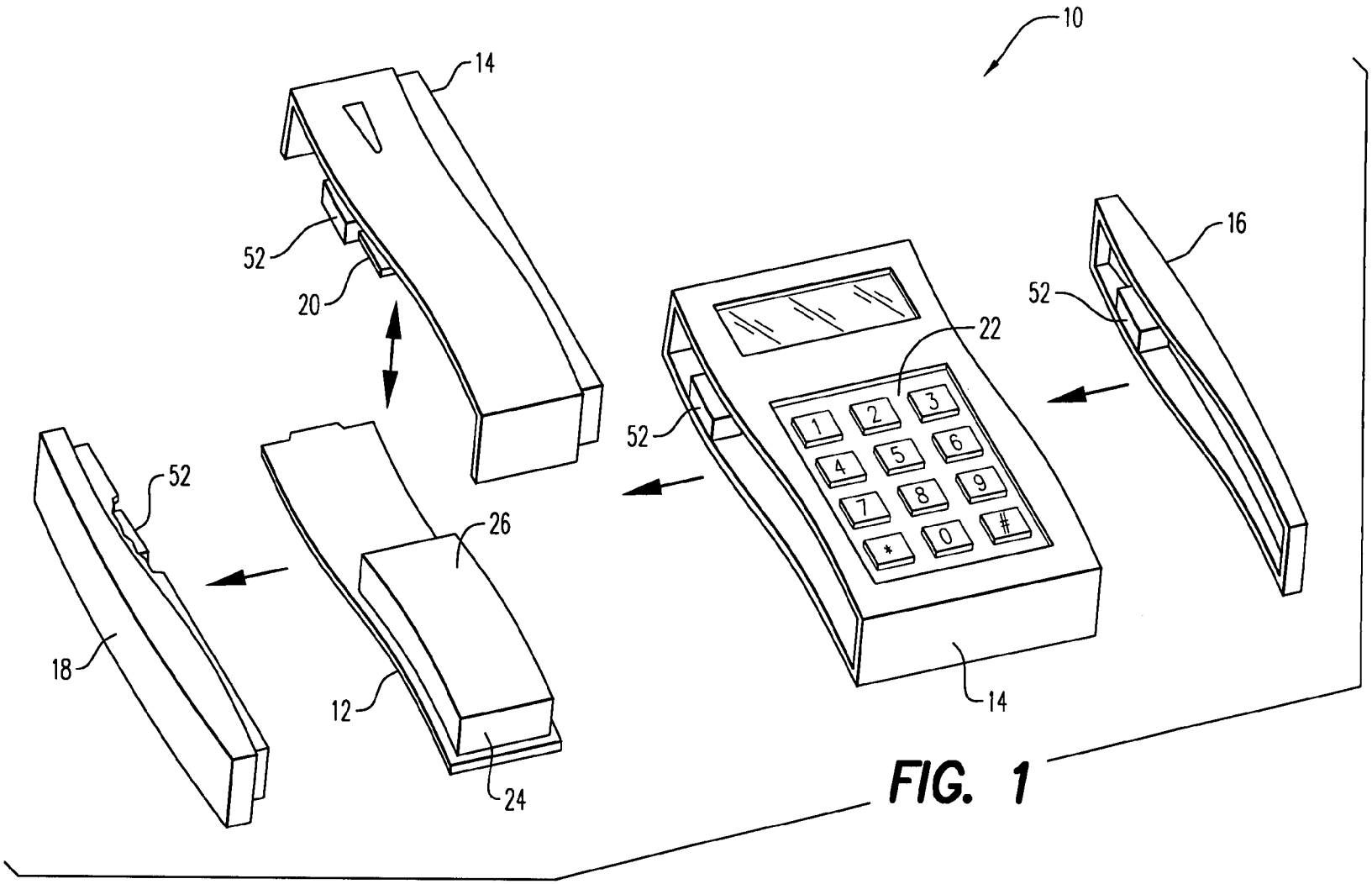
FIG. 1 is an exploded perspective view of an exemplary embodiment of a modular security, monitoring, and control device.

Referring to the drawings and in particular to FIG. 1, an exemplary embodiment of a modular security, monitoring, and control device generally represented by reference numeral 10 is illustrated. Modular device 10 includes a base 12, one or more peripherals 14, a first end cap 16, and a second end cap 18.

In the illustrated embodiment, modular device 10 is shown for purposes of clarity as an access control device. For example, one peripheral 14 can be a proximity type access reader 20 that snaps over base 12, while a second peripheral 14 can be a personal identification number (PIN) input keypad 22 that plugs into the first peripheral. When a user enters an authorized PIN via input keypad 22 or presents a badge to proximity reader 20, peripheral 14 can communicate via base 12 to open a door and, thus, provide the user with access to an otherwise secure area.

It should be recognized that modular device 10 is described herein by example having two peripherals 14. Of course, it is contemplated by the present disclosure for modular device 10 to one or more peripherals 14. For example, it is contemplated for modular device 10 to have as many peripherals as possible in the space available. It should also be recognized that peripherals 14 are described herein by example as a proximity reader 20 and a PIN data input keypad 22 for access control. Of course, it is contemplated by the present disclosure for the peripheral to be other types of access control peripherals, such as, but not limited to, a magnetic stripe reader, and others.

Moreover, it is contemplated by the present disclosure for peripheral 14 to have functions other than access control. For example, peripheral 14 can have functions, such as, but not limited to, temperature detection, smoke detection, intrusion entry alarms, lighting control, video surveillance, intercom communications, motion detection, asset resource tracking, inventory control, biometrics, closed circuit television, expense control tracking, personnel tracking, guard tour, product vending, HVAC monitoring, time/attendance monitoring, chemical agent sensing, biological agent sensing, optical sensors, and any combinations thereof.

In one embodiment, peripheral 14 can be a wireless communication peripheral (not shown) that allows a remote device to wirelessly communicate data to modular device 10. Alternately, it is contemplated for base 12 to include wireless communication functionality, such as in its input/output module 24 described in detail below.

Advantageously, base 12 provides modular device 10 with an open communication architecture to allow numerous different types of peripherals 14 to be incorporated into the modular device. For example, base 12 is capable of joining peripherals 14 that do not normally communicate with one another such as an access control peripheral and a video surveillance peripheral (not shown). As such, base 12 provides an integration platform for modular device 10 that enables the modular device to accept a wide array of data (e.g., access control data, smoke alarm data, intrusion alert data, employee time card data, etc) in a single, unified device. Specifically, the data, control, and monitoring activities of each peripheral 14 are centralized through base 12. As such, base 12 can provide modular device 10 with the ability to modify the decisions of the individual peripherals 14 based, at least in part, on data from other, similar or dissimilar peripherals.

Figure 2:
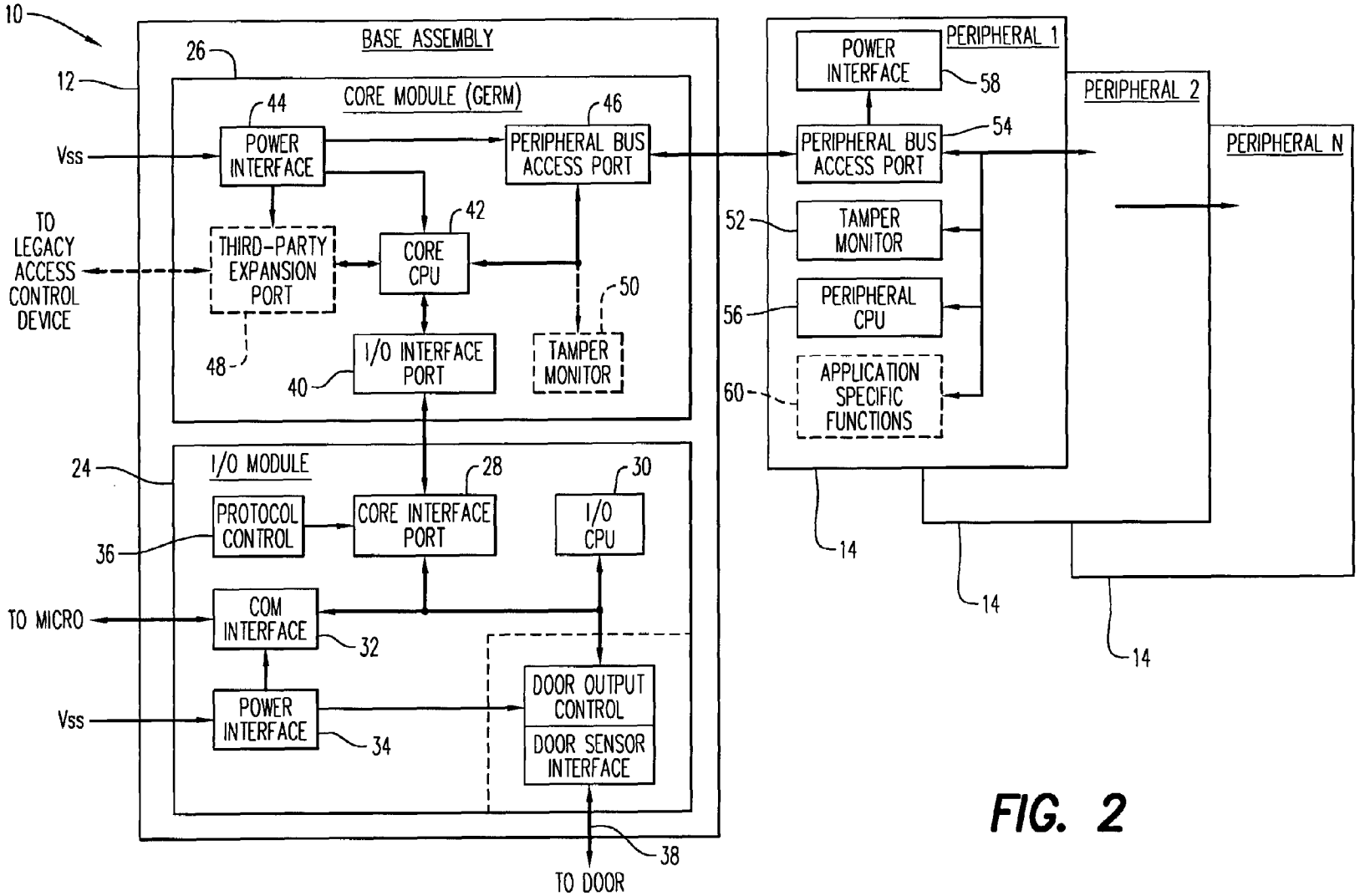
FIG. 2 is a block diagram of the modular device of FIG. 1.

In the illustrated embodiment, base 12 includes an input/output (I/O) module 24 and a core module 26. Exemplary embodiments of I/O module 24, core module 26, and peripherals 14 are described with simultaneous reference to FIGS. 1 and 2.

I/O module 24 includes a core interface 28, an I/O processor 30, a communications interface 32, and a power interface 34. Core interface 28 allows I/O module 24 to communicate with core module 26. In the illustrated embodiment, core interface 28 has a selected protocol control 36 to control the communications between the I/O and core modules 24, 26. Once I/O module 24 receives instruction from core module 26, I/O processor 30 can send an I/O signal 38 to control a remote device, such as a door. Additionally, I/O module 24 can receive I/O signal 38 from a remote device, such as a door sensor, and can send this data back to core module 26 and, thus to peripherals 14, as needed.

Core module 26 includes an I/O interface 40, a core processor 42, a power interface 44, and a peripheral bus access port 46. I/O interface 40 is in electrical communication with core interface 28 of I/O module 24 and facilitates communication between the I/O and core modules 24, 26. Core processor 42 processes information from I/O module 24 (e.g., I/O signal 38) via I/O interface 40 and information from peripherals 14 via port 46.

Power interfaces 34 and 44 are illustrated by way of example as separate devices. Of course, it is contemplated for power interfaces 34, 44 to each be in electrical communication with a common power bus (not shown) within modular device 10.

In some embodiments, core module 26 can include a third party expansion port 48 illustrated in phantom. Port 48 can allow modular device 10 to communicate with other peripheral devices and systems that are not physically compatible with the modular device. For example, port 48 can allow modular device 10 to communicate with a legacy or pre-existing access control device in place prior to the installation of the modular device. In this way, modular device 10 can supplement, rather than replace, existing systems by integrating the functionality and data from the existing system into the modular device.

In other embodiments, core module 26 can include a tamper monitor 50 illustrated in phantom. Tamper monitor 50 ensures, verifies, and/or detects (hereinafter "detect" or "detecting") that peripheral 14 and/or end caps 16, 18 have not been compromised or removed (hereinafter "tampered" or tampering). Thus, tamper monitor 50 can detect tampering with modular device 10.

For example and as seen in FIG. 1, tamper monitor 50 can be a set of interconnecting tamper shunts 52 defined on peripherals 14 and/or end caps 16, 18. When modular device 10 is in its assembled state, tamper shunts 52 mate with one another and communicate this interconnectivity to base 12. Tampering with peripherals 14 and/or end caps 16, 18 causes tamper monitor 50 to notify core processor 42.

It should be recognized that tamper monitor 50 is described above as detecting tampering by way of electrical communication with one or more components of modular device 10. Of course, it is contemplated by the present disclosure for tamper monitor 50 to detect tampering of modular device 10 by means such as, but not limited to, mechanical means, optical means, magnetic means, chemical means, biological means, and others.

Each peripheral 14 includes tamper shunt 52, a peripheral bus access port 54, and a peripheral processor 56. As discussed above, tamper shunt 52 allows tamper monitor 50 to detect whenever end caps 16, 18 and/or peripheral 14 have been tampered with. Port 54 places peripheral 14 in electrical communication with port 46 of core module 26. In addition, port 54 can place peripheral 14 in electrical communication with subsequent peripherals. Port 54 can be powered by power interface 44 of core module 26. Alternately, port 54 can be powered by a separate power interface 58 in peripheral 14.

In some embodiments, peripheral 14 can include one or more application specific functions 60 illustrated in phantom. For example in the embodiment discussed above where peripheral 14 is a PIN input keypad 22, application specific functions 60 can be the hardware and/or software necessary to enable the key pad of the PIN input keypad.

In order to assemble modular device 10, a user can choose the number and type of desired peripherals 14 necessary at a selected location. Modular device 10 is assembled by simply plugging a first peripheral 14 into base 12. Next, a second peripheral 14 can be plugged into the first peripheral 14. This process of plugging subsequent peripherals into the previous peripheral is repeated until the desired number of peripherals has been connected to one another and, thus, to base 12. Finally, end caps 16, 18 are used to terminate, both physically and electrically, the chain of peripherals. In the illustrated embodiment, end caps 16, 18 are simply plugged into base 12 and peripheral 14.

It should be recognized that modular device 10 is illustrated by example having end caps 16, 18 along the vertical sides of the device. Here, modular device 10 can be expanded by adding peripherals 14 along the width of the modular device. Of course, it is also contemplated for modular device 10 to include end caps 16, 18 along its top and/or bottom sides so that the modular device can be expanded by adding peripherals 14 along the height of the device. Further, it is contemplated for modular device 10 to include an end cap over the external face of base 12 and/or one or more of the peripherals 14. In this embodiment, peripherals 14 can be stacked on top of one another so that modular device 10 can be expanded along its depth. In this manner, modular device 10 can be expanded along its width, height, depth, and any combinations thereof.

Also, modular device 10 is illustrated by example having two end caps, namely first and second end caps 16, 18. Of course, it is contemplated for modular device 10 to have no end caps or as many end caps as desired. For example, it is contemplated by the present disclosure for peripheral 14 to have an enclosed edge such that end caps are not required.

In some embodiments, modular device 10 has, what is commonly referred to as, plug-and-play functionality. Specifically, core processor 42 is configured to recognize when peripheral 14 has been added to modular device 10. Thus, modular device 10 can be expanded by merely plugging peripheral 14 into base 12.

Advantageously, modular device 10 provides flexibility in both the manufacture of the device, as well as in the field installation and expansion of the device. In the area of manufacturing flexibility, only one base 12 is needed for the various types of peripherals 14. Thus, the manufacturer merely configures the desired functionality by selecting from the various types of peripherals 14 that are offered. In the area of flexibility in the field, modular device 10 allows the customer to easily select the desired functionality by selecting from the various types of peripherals 14 that are offered. Further, modular device 10 allows the customer to easily upgrade their system by removing one of the end caps 16, 18, plugging in the newly desired peripheral 14, and re-installing the removed end cap.

Accordingly, modular device 10 can easily be modified and expanded by the manufacturer before installation or by the user after installation. In addition, modular device 10 reduces the time necessary to install the device as compared to the previously available devices. Further, repair time can be reduced since the components of modular device 10 (e.g., I/O module 24, core module 26, peripherals 14) can be upgraded or replaced independent of the other components.

It should also be noted that the terms "first", "second", "third", "upper", "lower", and the like may be used herein to modify various elements. These modifiers do not imply a spatial, sequential, or hierarchical order to the modified elements unless specifically stated.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that the invention will include all embodiments falling within the scope of the appended claims.

What is claimed is:

1. A modular security, monitoring, and control device comprising:

a core module and an input/output module in electrical communication with one another;

a first peripheral being removably connected to said core module so that said core module and said first peripheral are in electrical communication;

a first end cap being removably connected to said first peripheral;

a tamper monitor that detects tampering with said first peripheral; and a second peripheral being removably connected between said first peripheral and said first end cap so that said second peripheral is in electrical communication with said core module through said first peripheral.

2. The modular security, monitoring, and control device as in claim 1, wherein said tamper monitor detects tempering with said second peripheral.

3. The modular security, monitoring, and control device as in claim 1, wherein said first and second peripherals each has a function selected from the group consisting of access control, temperature detection, smoke detection, intrusion entry alarms, lighting control, video surveillance, intercom communications motion detection, asset resource tracking, inventory control, biometrics, closed circuit television, expense control tracking, personnel tracking, guard tour, product vending, HVAC monitoring, time/attendance monitoring, chemical agent sensing, biological agent sensing, optical sensors, and any combinations thereof.

4. The modular security, monitoring, and control device as in claim 1, further comprising a second end cap removably connected to said core module.

5. A modular security, monitoring, and control device comprising:

a core module and an input/output module in electrical communication with one another;

a first peripheral being removably connected to said core module so that said core module and said first peripheral are in electrical communication;

a first end cap being removably connected to said first peripheral;

a tamper monitor that detects tampering with said first peripheral;

a second end cap removably connected to said core module; and a second peripheral being removably connected between said core module and said second end cap, said second peripheral being in electrical communication with said core module.

6. A modular security, monitoring, and control device comprising:

a core module and an input/output module in electrical communication with one another;

a first peripheral being removably connected to said core module so that said core module and said first peripheral are in electrical communication;

a first end cap being removably connected to said first peripheral; and a tamper monitor that detects tampering with said first peripheral, wherein said core module includes a third party expansion port for placing said core module in electrical communication with a third party peripheral.

7. The modular security, monitoring, and control device as in claim 1, wherein said core module and said input/output module are configured to communicate with a plurality of peripherals having a plurality of different data types.

8. A modular security, monitoring, and control device comprising:

a processor in electrical communication with an input/output device; and a plurality of peripheral devices secured to said processor so that each of said plurality of peripheral devices is in electrical communication with said processor, said processor being configured to collect a plurality of different data types from said plurality of peripheral devices, and further comprising a first end cap removably secured to one of said plurality of peripheral devices.

9. The modular security, monitoring, and control device as in claim 8, further comprising a tamper monitor for detecting tampering with said plurality of peripheral devices.

10. The modular security, monitoring, and control device as in claim 8, further comprising a tamper monitor for detecting tampering with said plurality of peripheral devices and/or said first end cap.

11. The modular security, monitoring, and control device as in claim 8, wherein said plurality of peripheral devices each has a function selected from the group consisting of access control, temperature detection, smoke detection, intrusion entry alarms, lighting control, video surveillance, intercom communications, motion detection, asset resource tracking, inventory control, biometrics, closed circuit television, expense control tracking, personnel tracking, guard tour, product vending, HVAC monitoring, time/attendance monitoring, chemical agent sensing, biological agent sensing, optical sensors, and any combinations thereof.

12. The modular security, monitoring, and control device as in claim 8, further comprising a third party expansion port for placing said processor in electrical communication with a third party peripheral device.

13. The modular security, monitoring, and control device as in claim 8, wherein processor and said input/output device are disposed in a base, said base being configured so that said plurality of peripheral devices expand from said base in a direction selected from the group consisting of a width direction, a height direction, a depth direction, and any combinations thereof.

14. A method of forming a security, monitoring, and control device comprising:

placing a core module in electrical communication with an input/output module, said core module being configured to place said input/output module in electrical communication with a plurality of peripherals having a plurality of different data types; and plugging a first peripheral into said core module so that said first peripheral is physically connected to and is in electrical communication with said core module, further comprising plugging a first cap into said first peripheral so that said first end cap is physically connected to said first peripheral.

15. The method as in claim 14, further comprising detecting tampering with said first peripheral.

16. The method as in claim 14, further comprising detecting tampering with said first end cap.

17. The method as in claim 14, further comprising:

removing said first end cap from said first peripheral;

plugging a second peripheral into said first peripheral so that said second peripheral is physically connected to and is in electrical communication with said core module through said first peripheral; and plugging said first end cap into said second peripheral so that said first end cap is physically connected to said second peripheral.

18. The method as in claim 17, further comprising communicating data collected from said first peripheral and said second peripheral to said input/output module through said core module.

19. The method as in claim 18, wherein said first and second peripherals each has a function selected from the group consisting of access control, temperature detection, smoke detection, intrusion entry alarms, lighting control, video surveillance, intercom communications, motion detection, asset resource tracking, inventory control, biometrics, closed circuit television, expense control tracking, personnel tracking, guard tour, product vending, HVAC monitoring, time/attendance monitoring, chemical agent sensing, biological agent sensing, optical sensors, and any combinations thereof.

* * * * *